US005763844A

United States Patent [19]

Seymour et al.

[11] Patent Number: 5,763,844

[45] Date of Patent: Jun. 9, 1998

[54] INTERLOCK ARRANGEMENT FOR STATIONARY MOUNTED CIRCUIT BREAKERS

[75] Inventors: Raymond K. Seymour, Plainville; Michael C. Guerrette, Bristol; William H. Calder; Dennis J. Doughty, both of Plainville, all of Conn.

[73] Assignee: General Electric Company, New York, N.Y.

[21] Appl. No.: 766,921

[22] Filed: Dec. 13, 1996

[51] Int. Cl.[6] ..... H01H 9/26

[52] U.S. Cl. ..... 200/50.33

[58] Field of Search ..... 200/50.32, 50.4, 200/5 B–5 D; 74/483 PB, 483 R; 335/159–161, 120; 337/288, 337–339

[56] References Cited

U.S. PATENT DOCUMENTS

| | | | |
|---|---|---|---|
| 2,531,157 | 11/1950 | Pifke | 200/50.33 |
| 2,646,474 | 7/1953 | Stratton | 200/50.33 |
| 3,149,210 | 9/1964 | Haydu et al. | 200/50.32 |
| 3,233,052 | 2/1966 | Contal | 200/50.33 |
| 3,663,773 | 5/1972 | Powell | 200/50.24 |
| 4,286,242 | 8/1981 | Mrenna et al. | 200/50.33 X |
| 4,317,160 | 2/1982 | Tillson et al. | 361/609 |
| 4,489,362 | 12/1984 | Castonguay et al. | 361/609 |
| 4,499,344 | 2/1985 | Castonguay et al. | 200/50.33 |
| 4,516,100 | 5/1985 | Wallace et al. | 200/50.33 |
| 4,827,089 | 5/1989 | Morris et al. | 200/50.33 |
| 4,902,859 | 2/1990 | Witzmann et al. | 200/50.33 |
| 5,043,687 | 8/1991 | Gibson | 200/50.35 |
| 5,436,415 | 7/1995 | Smith et al. | 200/50.35 |
| 5,651,451 | 7/1997 | Castonguay et al. . | |

OTHER PUBLICATIONS

U.S. application No. 08/653,596, R.K. Seymour, et al., Interlock Arrangement for Circuit Breaker Compartments, filed May 24,1996.

*Primary Examiner*—J. R. Scott

*Attorney, Agent, or Firm*—Richard A. Menelly; Carl B. Horton

[57] ABSTRACT

The circuit breaker interlock arrangement of the invention utilizes a pair of detector assemblies, one mounted on the rear surface of each one of a pair of first and second adjoining circuit breakers and interconnected by means of an elongated rod. The operating mechanism tripping plunger rod in the first circuit breaker trips the associated first circuit breaker operating mechanism to open the first circuit breaker contacts when an attempt is made to close the first circuit breaker contacts when the second circuit breaker contacts in the second circuit breaker are already closed, and vice versa.

10 Claims, 6 Drawing Sheets

INTERLOCK ARRANGEMENT FOR STATIONARY MOUNTED CIRCUIT BREAKERS

BACKGROUND OF THE INVENTION

Circuit breakers generally employ an interlock arrangement to prevent one of a pair of circuit breakers from being turned on to connect with an electrical source of power when the other circuit breaker is connected to a separate power source.

Examples of interlocked circuit breaker compartments are found in the following U.S. patents. U.S. Pat. No. 3,663,773 entitled "Switchgear Draw-out Apparatus With Clutch Interlock" discloses an interlock mechanism that interferes with the contact push rod when the circuit breaker contacts are closed for preventing withdrawal of the circuit breaker. U.S. Pat. No. 4,317,160 entitled "Electrical Switchboard Having Improved Drawout Apparatus" discloses an interlock mechanism which operates on the tripping plunger rod to prevent the circuit breaker from being removed from the compartment power stabs when the circuit breaker contacts are closed.

U.S. Pat. No. 4,489,362 entitled "Electric Switchboard Apparatus With A Breaker-Fuse Interlock" and U.S. Pat. No. 4,499,344 entitled "Interlock Arrangement for Circuit Breaker Compartments" are representative of the state-of-the-art of such interlocked circuit breakers as used with main and auxiliary circuit breaker installations to insure that only one circuit breaker is operational within a given electrical distribution circuit at one time.

With such interlock arrangements, the stand-by circuit breaker generally remains in a non-reset condition such that the circuit breaker operating springs must be charged before the stand-by circuit breaker is turned ON to replace the operating circuit breaker. U.S. Pat. No. 5,651,451, filed Mar. 1, 1996 entitled "System For Resetting High Ampere Rated Circuit Breaker Operating Springs" describes a circuit breaker wherein the circuit breaker operating mechanism springs are charged after contact separation to allow rapid connection of the circuit breaker contacts within the associated electrical distribution system.

U.S. patent application Ser. No. 08/653,596, filed May 24, 1996 entitled "Interlock Arrangement for Circuit Breaker Compartments" describes an arrangement for interlocking between circuit breaker compartments wherein the disconnected circuit breaker remains fully charged. Part of the interlock components are arranged on the rear of the circuit breakers and part of the interlock components are arranged within the respective compartments.

In stationary arrangements wherein the interlocked circuit breakers are in fixed positions and are turned ON and OFF by operating handles, the logic interlock components are completely arranged on the rear of the circuit breakers, per se.

One purpose of the invention, accordingly, is to provide a circuit breaker interlock arrangement wherein the interlock components are attached to the rear surface of each of the interlocked circuit breakers and wherein the disconnected circuit breaker remains in a fully charged condition for rapid turn- on when the interlocked operating circuit breaker is turned off.

SUMMARY OF THE INVENTION

The circuit breaker interlock arrangement of the invention utilizes a pair of detector assemblies, one mounted on the rear surface of each one of a pair of first and second adjoining circuit breakers and interconnected by means of an elongated rod. The operating mechanism tripping plunger rod in the first circuit breaker trips the associated first circuit breaker operating mechanism to open the first circuit breaker contacts when an attempt is made to close the first circuit breaker contacts when the second circuit breaker contacts in the second circuit breaker are already closed, and vice versa. An override link arrangement insures that a predetermined one of the interlocked circuit breakers will turn on in the event of a race condition between both circuit breakers.

DESCRIPTION OF THE PREFERRED EMBODIMENT

Figure 1:
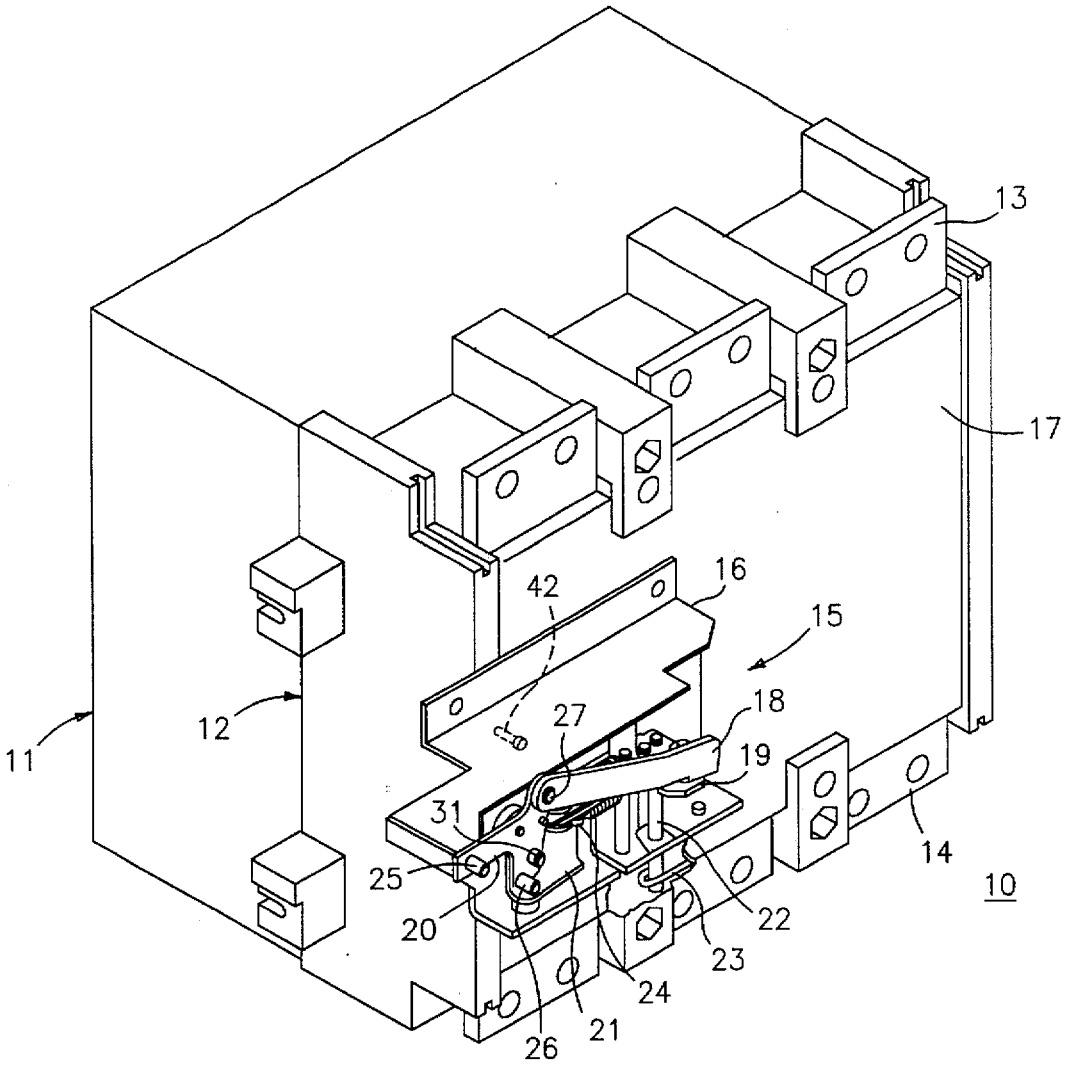
FIG. 1 is a top perspective view of an interlock detector assembly attached to the rear of a circuit breaker according to the invention.

In accordance with the teachings of the invention an industrial-rated circuit breaker 10 consisting of a cover 11 attached to a case 12 is arranged with the line straps 13 extending from the tip of the case and the load straps 14 extending from the bottom thereof is depicted in FIG. 1. An interlock detector assembly 15, hereinafter "detector assembly" fastened to the back 17 of a U-shaped detector frame 16 is attached to the rear surface of the case 12 and positioned to interact the control lever pin 22 with the circuit breaker trip lever 23 and to interact the circuit breaker plunger rod 42 (hereinafter shown in phantom) with the sensor lever 21 to control the condition of the circuit breaker contacts (not shown). The interaction between a circuit breaker plunger and a circuit breaker trip lever is described in greater detail within the aforementioned U.S. patent application Ser. No. 08/653,596. A T-shaped lever 20 having extending posts 25, 26, 27, 31 interconnects the detector assembly with a separate detector assembly by means of a connecting rod 52 (FIG. 3), control lever 19 and with the detector lever control link 18. A connector link 24 is used to insure that one of a pair of such interlocked circuit breakers will prevail if a race condition exists between the circuit breakers in the manner to be described below.

Figure 2A:
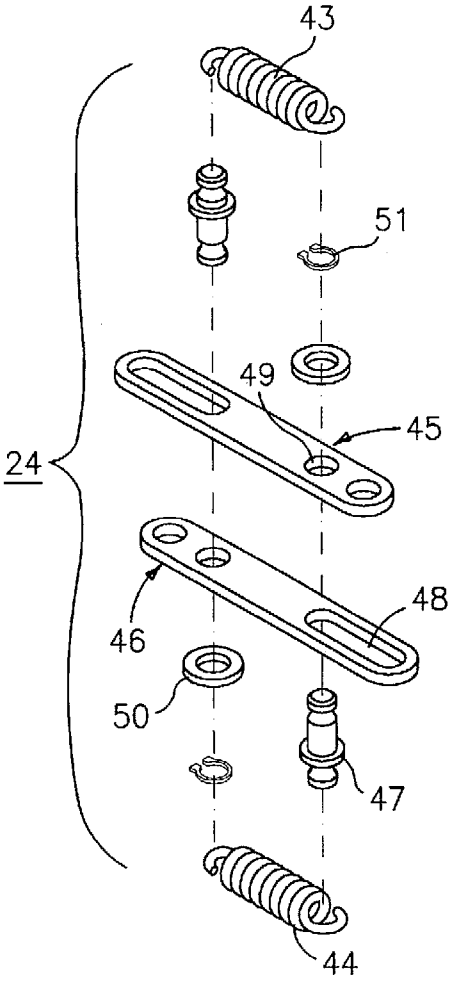
FIG. 2A is a top perspective view, in isometric projection, of the connector link components within the detector assembly of FIG. 1.
Figure 2:
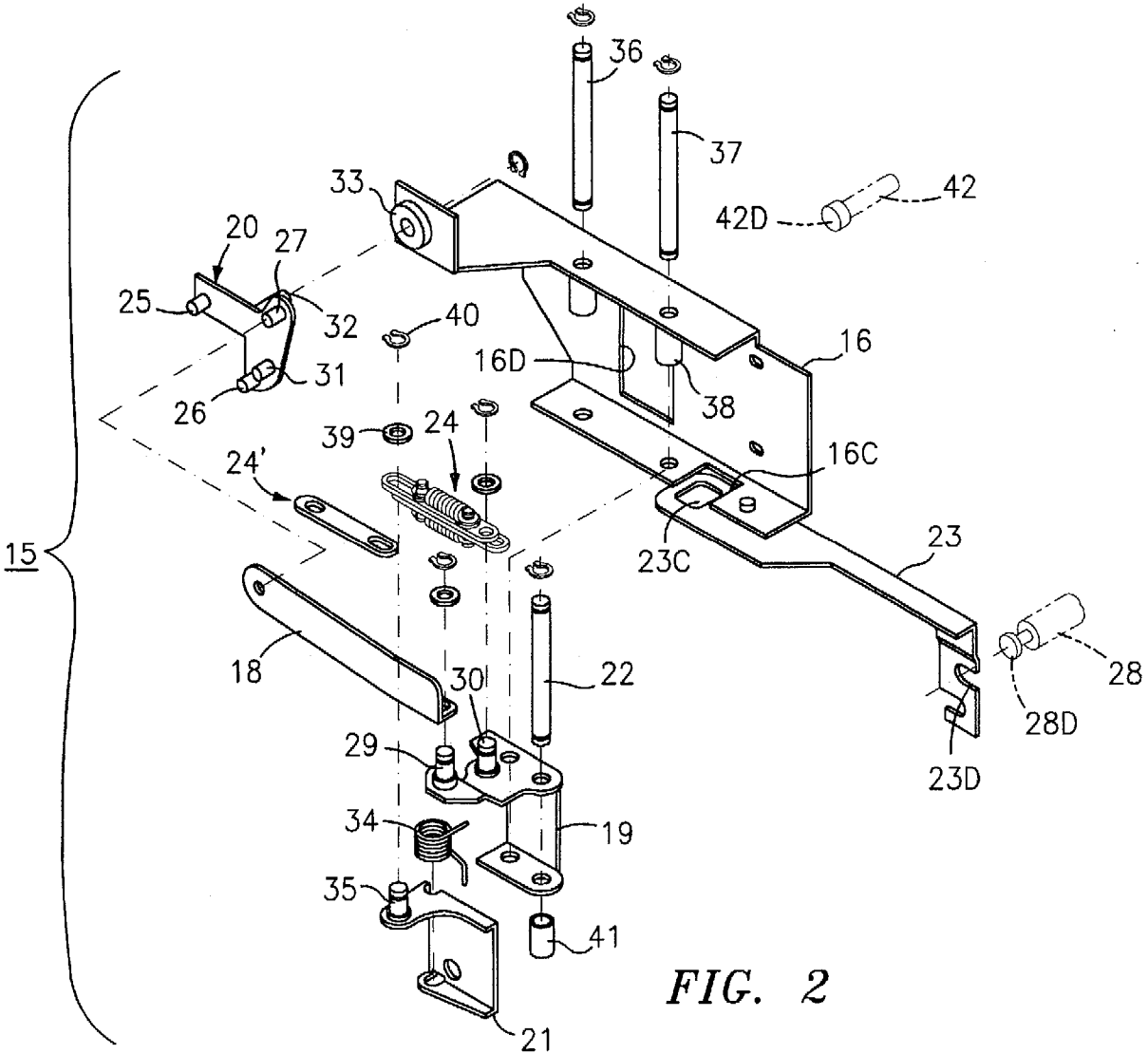
FIG. 2 is a top perspective view, in isometric projection, of the components within the detector assembly of FIG. 1.

The detector assembly 15 is best seen by now referring to FIG. 2 wherein the detector frame 16 is positioned in such a manner that the rectangular slot 16C receives the end of the circuit breaker trip lever 23 and the and the rectangular slot 16D receives the end 42D of the circuit breaker plunger rod 42. The end 28D of the circuit breaker trip rod 28 (also depicted in phantom) attaches to the slot 23D within the circuit breaker trip lever 23 to set the logic between the condition of the circuit breaker contacts in the manner to be described below. A pair of support pins 36, 37 extend through bushings 38 to support the sensor lever 21, sensor lever return spring 34, control lever 19, connector link 24 and the control link 18. The T-shaped lever 20, hereinafter "T-lever" connects with the frame 16 by means of the pin 32 and bushing 33, with the control link 18 and connecting rod 52 (FIG. 3) by means of one of the posts 25, 26, 27, 31. The connector link 24 attaches to the control lever 19 at one end by means of the post 30 and to the sensor lever 21 at the opposite end by means of the post 35. The control link 18 attaches to the control lever 19 by means of the post 29. The control lever pin 22 attaches with the control lever 19 and carries a roller 41 at a bottom end which extends through the slot 16C at the bottom of the frame 16 and through the slot 23C within the circuit breaker trip lever 23 shown in phantom. Washers 39 and snap ring connectors 40 are used throughout to retain the components and to insure relative motion between the components with the least amount of friction.

The override feature of the connector link 24, as shown in FIG. 2A, is provided by the springs 43, 44, which connect with the links 45, 46 by means of slots 48, apertures 49, double-ended pins 47, washers 50 and snap rings 51. This insures relative motion between the two links 45, 46 when a force is applied to the ends thereof by means of either the sensor lever 21 or the control lever 19 shown earlier in FIG. 2. When the solid connector link 24' shown in FIG. 2 is used in one of the detector assemblies 15 and the and the connector link 24 employing springs 43, 44 shown in FIG. 2A is used within the other detector assembly, the single connector link 24' will overcome the springs within the connector link 24 and insure that the circuit breaker associated with the connector link 24 employing springs 43, 44 will become tripped in the event an attempt is made to turn on one of the interlocked circuit breakers when the other is already on, or if a race attempt is made to turn on both of the interlocked circuit breakers at the same time.

Figure 3:
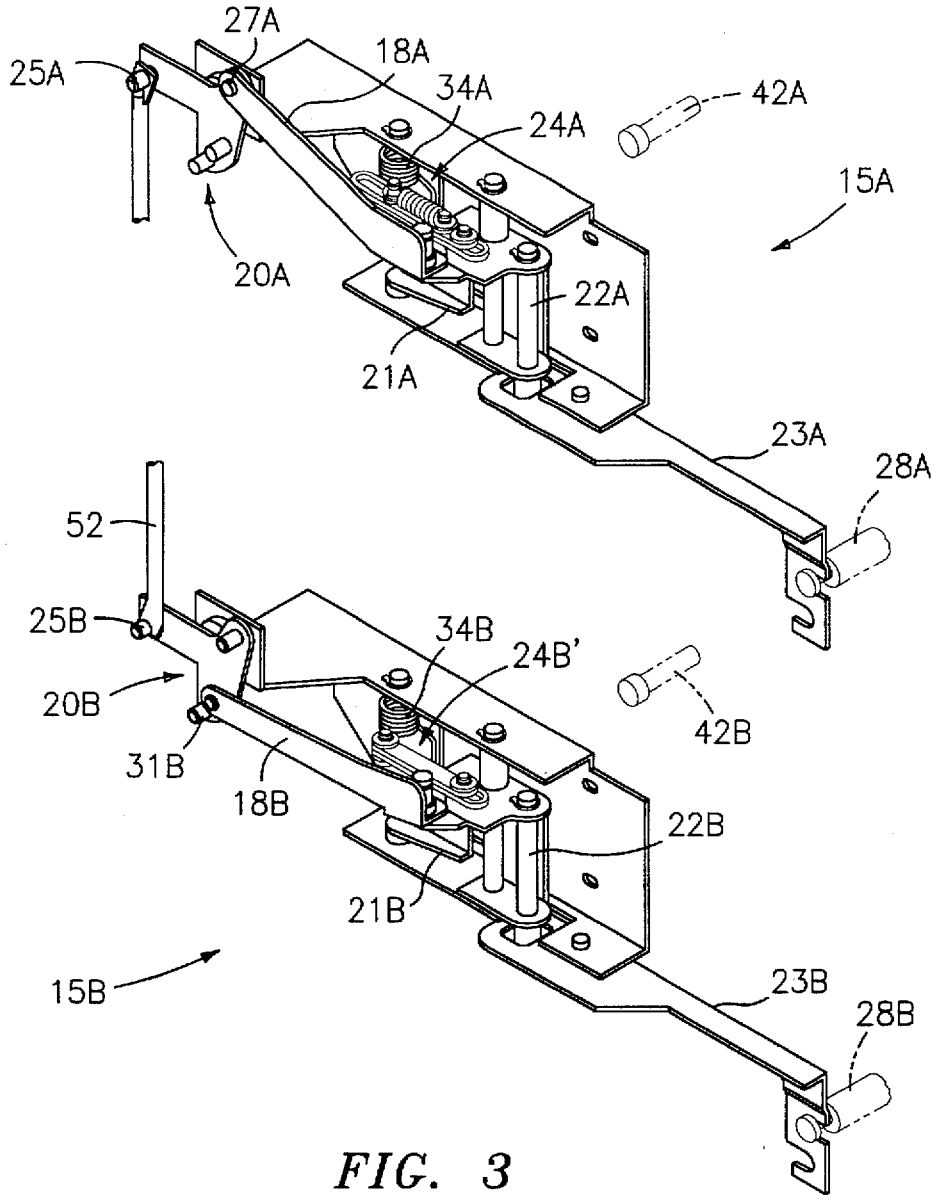
FIG. 3 is a top perspective view of a pair of detector assemblies used with a pair of circuit breakers interlocked in a vertical array.

FIG. 3 depicts a pair of vertically-interlocked detector assemblies 15A, 15B with the associated circuit breakers omitted for purposes of clarity. The circuit breaker plunger rods 42A, 42B shown in phantom interact with the associated sensor levers 21A, 21B to provide Logic indication as to whether the contacts within the associated circuit breakers are open or closed. The circuit breaker trip levers 23A, 23B and attached circuit breaker trip rods 28A, 28B respond to immediately trip the circuit breaker associated with the detector assembly 15A in the event the circuit breaker associated with the detector assembly 15B is already on since the detector assembly 15B contains the solid connector link 24'B and the detector assembly 15A contains the by-pass connector link 24A. The detector assemblies 15A, 15B are interconnected by means of the connecting rod 52 which attaches with the bottom posts 25A, 25B of the T-levers 20A, 20B. The control link 18A is connected with the left post 27A at one end and to the sensor lever 21A at the opposite end. The control link 18B is connected with the right post 31B at one end and to the sensor lever 21B at the opposite end. Contact with the corresponding circuit breaker plunger rods 42A, 42B rotates the corresponding sensor levers 21A, 21B against the bias of the return springs 34A, 34B thereby rotating the respective control lever pins 22A, 22B to move the associated circuit breaker trip levers 23A, 23B accordingly.

The mechanical logic arrangement between a vertically-interlocked upper circuit breaker 10A and a vertically-interlocked lower circuit breaker 10B is depicted in the following FIGS. 4A–4B.

The components within the upper detector assembly 15A associated with the upper circuit breaker 10A are characterized by the letter A and the components within the lower detector assembly 15B associated with the lower circuit breaker 10B are characterized by the letter B for common components within both assemblies.

Figures 4A, 4B, 4C:
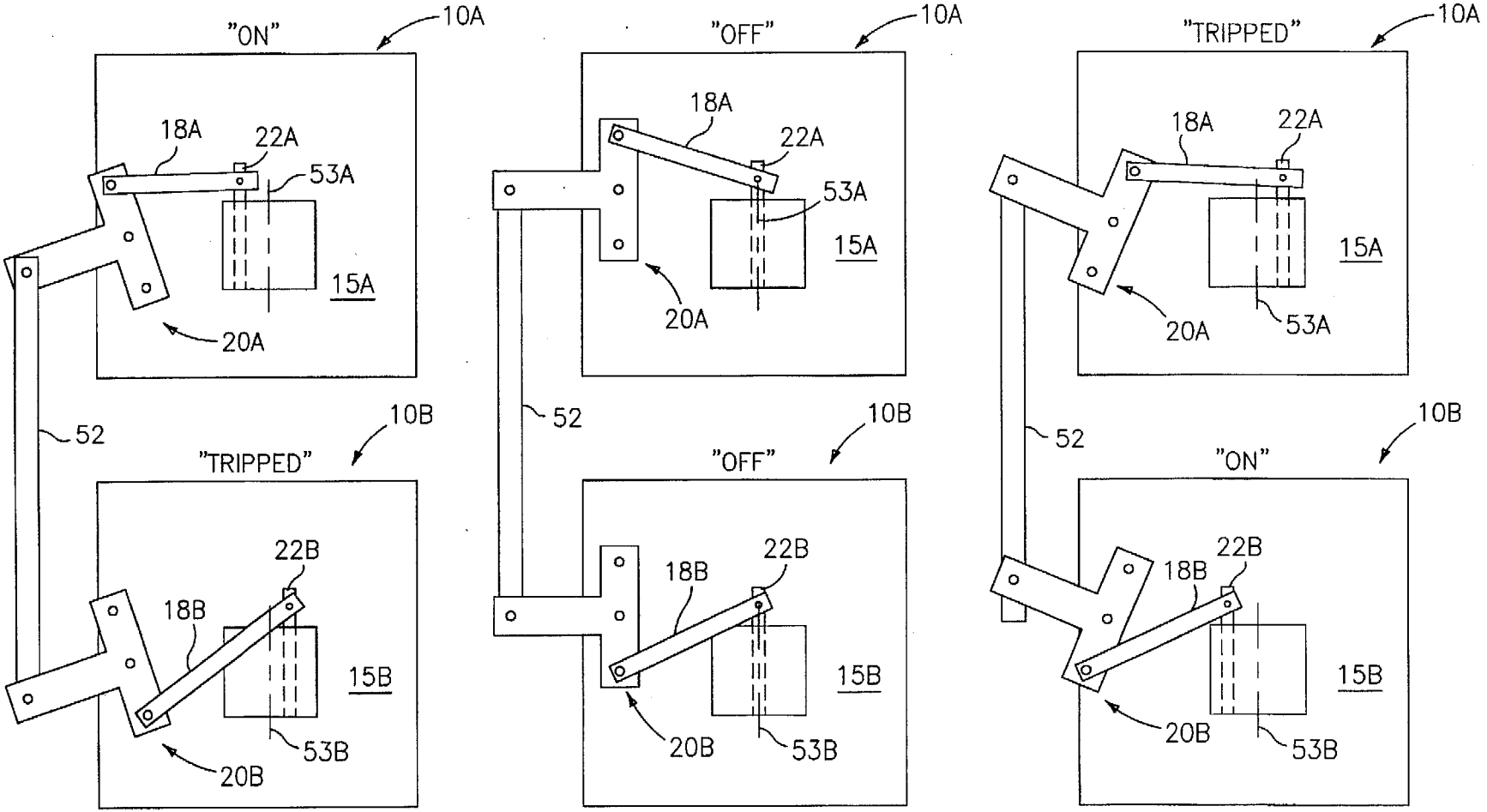
FIGS. 4A–4C are schematic representations of the mechanical logic associated with the vertical circuit breaker arrangement depicted in FIG. 3.

With the circuit breaker 10A in the ON condition and the circuit breaker 10B in the TRIPPED condition as shown in FIG. 4A, the control link 18A connecting with the T-shaped lever 20A in the detector assembly 15A is in the horizontal plane and the control lever pin 22A is to the left of the center line 53A. The control link 18B attached to the T-shaped lever 20B in the detector assembly 15B by means of the connecting rod 52 has been rotated counter-clockwise such that the attached control link 18B extends downwards from the horizontal plant and the attached control lever pin 22B is to the left of the center line 53B.

With the circuit breaker 10A in the OFF condition and the circuit breaker 10B in the OFF condition as shown in FIG. 4B, the T-shaped lever 20A within the detector assembly 15A has rotated the control link 18A in the clockwise direction such that the control lever pin 22A is in line with the center line 53A. The T-shaped lever 20B, in the detector assembly 15B, has rotated the control link 18B in the clockwise direction such that the connecting rod 52 has rotated counter-clockwise whereby the attached control link 18B positions the attached control lever pin 22B in line with the center line 53B.

With the circuit breaker 10A in the TRIPPED condition and the circuit breaker 10B in the ON condition as shown in FIG. 4C, the T-shaped lever 20A within the detector assembly 15A has rotated the control link 18A in the counter-clockwise direction such that the control lever pin 22A is to the right of the center line 53A. The T-shaped lever 20B in the detector assembly 15B by attachment with the connecting rod 52 has rotated the control link 18B in the clockwise direction such that the attached control link 18B positions the attached control lever pin 22B to the left of the center line 53B.

Figure 5:
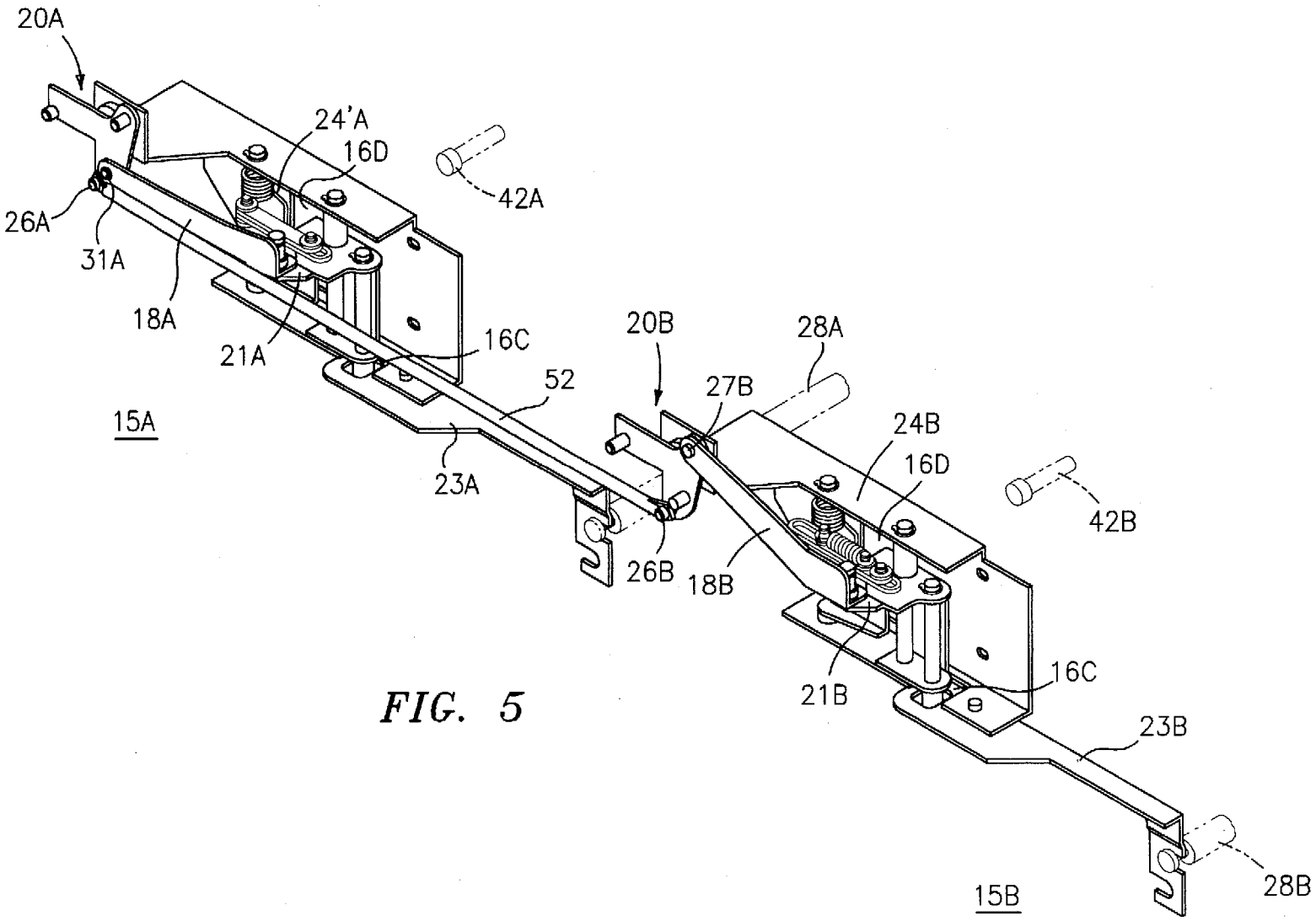
FIG. 5 is a top perspective view of a pair of detector assemblies used with a pair of circuit breakers interlocked in a horizontal array.

FIG. 5 depicts a pair of horizontally-interlocked detector assemblies 15A, 15B with the associated circuit breakers omitted for purposes of clarity. The circuit breaker plunger rods 42A, 42B shown in phantom interact with the associated sensor levers 21A, 21B through the openings 16D to provide Logic indication as to whether the contacts within the associated circuit breakers are open or closed. The circuit breaker trip levers 23A, 23B and attached circuit breaker trip rods 28A, 28B interact with the sensor levers 21A, 21B by means of the openings 16C to immediately trip the circuit breaker associated with the detector assembly 15B in the event the circuit breaker associated with the detector assembly 15B is already connected. This occurs since the detector assembly 15A contains the solid connector link 24'A and the detector assembly 15B contains the by-pass connector link 24B. The detector assemblies 15A, 15B are interconnected by means of the connecting rod 52 which attaches with the right posts 26A, 26B of the T-levers 20A, 20B. The control link 18A connects with the pin 31A on the T-shaped lever 20A while the control link 18B connects with the left post 27B on the T-shaped lever 20B.

The mechanical logic arrangement between a horizontally-interlocked circuit breaker 10A and a horizontally-interlocked circuit breaker 10B is depicted in the following FIGS. 6A–6B.

The components within the detector assembly 15A associated the circuit breaker 10A are characterized by the letter A and the components within the detector assembly 15B associated with circuit breaker 10B are characterized by the letter B for common components within both assemblies.

Figure 6A:
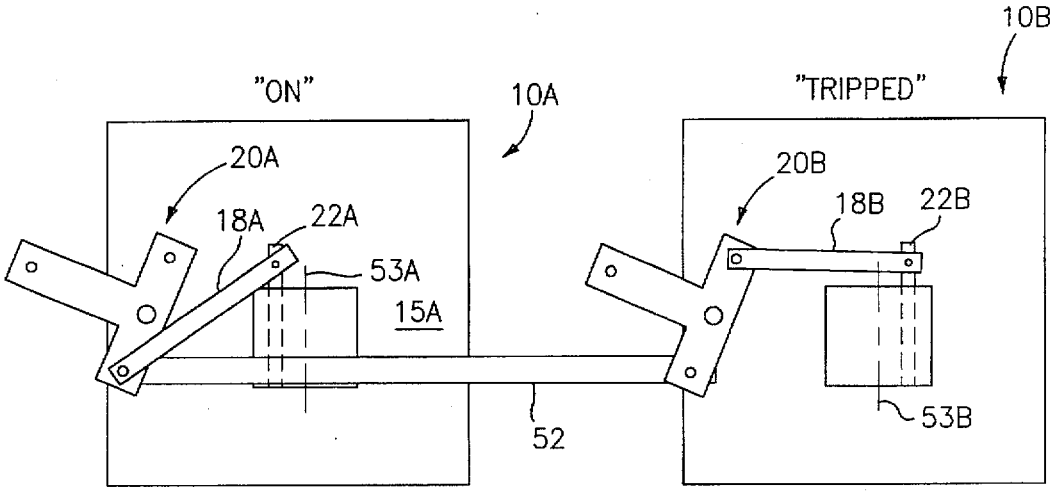
FIGS. 6A–6C are schematic representations of the mechanical logic associated with the horizontal circuit breaker arrangement depicted in FIG. 5.

With the circuit breaker 10A in the ON condition and the circuit breaker 10B in the TRIPPED condition as shown in FIG. 6A, the control link 18A connecting with the T-shaped lever 20A in the detector assembly 15A is rotated clockwise and the control lever pin 22A is to the left of the center line 53A. The T-shaped lever 20B attached to the T-shaped lever 20A by means of the connecting rod 52 is rotated counter-clockwise such that the attached control link 18B extends parallel to the horizontal plane and the attached control lever pin 22B is to the left of the center line 53B.

Figure 6B:
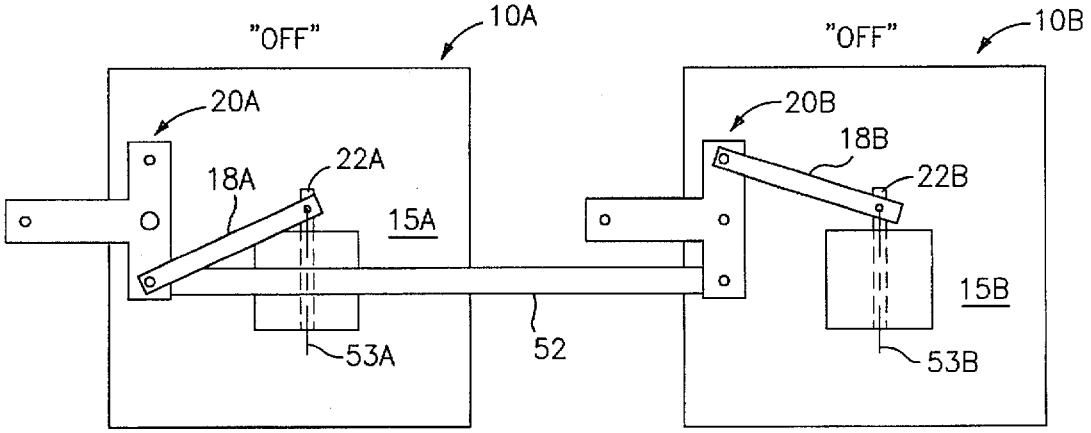

With the circuit breaker 10A in the OFF condition and the circuit breaker 10B in the OFF condition as shown in FIG. 6B, the T-shaped lever 20A within the detector assembly 15A is rotated in the counter-clockwise direction such that the control link 18A positions the control lever pin 22A in line with the center line 53A. The T-shaped lever 20B in the detector assembly 15B is rotated in the clockwise direction such the control link 18B positions the attached control lever pin 22B in line with the center line 53B.

Figure 6C:
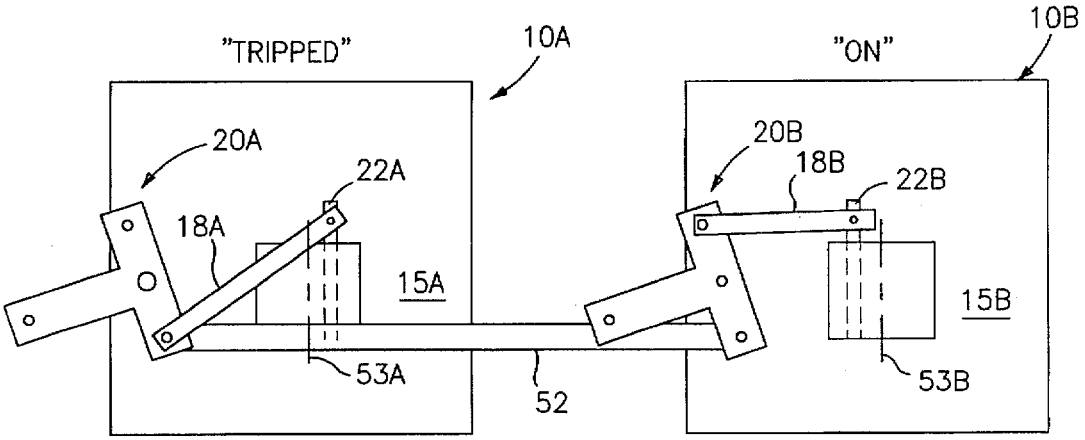

With the circuit breaker 10A in the TRIPPED condition and the circuit breaker 10B in the ON condition as shown in FIG. 6C, the T-shaped lever 20A within the detector assembly 15A is rotated in the counter-clockwise direction such that the control link 18A positions the control lever pin 22A in line with the center line 53A. The T-shaped lever 20B in the detector assembly 15B is rotated in the clockwise direction such that the attached control link 18B positions the attached control lever pin 22B to the left of the center line 53B.

An arrangement for interlocking between high ampere-rated circuit breakers has herein been described wherein only one of a pair of interlocked circuit breakers can be turned on at one time. The circuit breakers although turned to the TRIPPED condition within the compartment is capable of later being turned on without having to recharge the circuit breaker operating mechanism closing springs.

We claim:

1. A circuit breaker interlock assembly comprising:

a first circuit breaker interlock mounted on a first circuit breaker and associated with a first contact push rod extending from said first circuit breaker to sense whether first contacts within said first circuit breaker are closed and associated with a first circuit breaker trip rod to actuate said first circuit breaker trip rod and separate said first contacts;

a second circuit breaker interlock mounted on a second circuit breaker associated with a second contact push rod extending from said second circuit breaker to sense whether second contacts within said second circuit breaker are closed and associated with a second circuit breaker trip rod to actuate said second circuit breaker trip rod and separate said second contacts when an attempt is made to electrically connect said second circuit breaker when said first circuit breaker is already electrically connected, said first circuit breaker interlock comprises a first detector assembly connecting with said first circuit breaker trip rod and said second circuit breaker interlock comprises a second detector assembly connecting with said second circuit breaker trip rod, said first and second detector assemblies are interconnected by an extended connecting rod, said first detector assembly comprises a first support frame attached to said first circuit breaker, a first control lever pivotally attached to said first support frame, a first sensor lever pivotally attached to said first support frame, said first sensor lever being attached to said first control lever at one end of a first connector link, an opposite end of said first connector link being attached to a first T-shaped lever, said second detector assembly comprises a second support frame attached to said second circuit breaker, a second control lever pivotally attached to said second support frame, a second sensor lever pivotally attached to said second support frame, said second sensor lever being attached to said second control lever at one end of a second connector link, an opposite end of said second connector link being attached to a second T-shaped lever whereby said first connector link exerts a first mechanical force and said second connector link exerts a second mechanical force greater than said first force, whereby said first circuit breaker contacts become separated when an attempt is made to connect said first and second circuit breakers at the same time.

2. The interlock assembly of claim 1 wherein said first sensor lever is pivotally arranged about a first return spring for returning said first sensor lever to a home position in the absence of contact with said first contact push rod.

3. The interlock assembly of claim 1 wherein said second sensor lever is pivotally arranged about a second return spring for returning said second sensor lever to a home position in the absence of contact with said second contact push rod.

4. The interlock assembly of claim 1 wherein said first connector link comprises a pair of slotted links joined together by at least one override spring.

5. The interlock assembly of claim 1 wherein said second connector link comprises an unslotted link.

6. The interlock assembly of claim 1 wherein said first T-shaped lever defines a first crossarm and a first extending leg, and said second T-shaped lever defines a second crossarm and a second extending leg.

7. The interlock assembly of claim 6 wherein a first control link and a first end of said connecting rod are connected to said first crossarm, and wherein a second control link is connected to one end of said second crossarm and a second end of said connecting rod is connected to an opposite end of said second crossarm.

8. The interlock assembly of claim 7 wherein said first control link is connected to said first crossarm and a first end of said connecting rod is connected to said first extending leg, and wherein said second control link is connected to said second crossarm and a second end of said connecting rod is connected to said second extending leg.

9. The interlock assembly of claim 1 wherein said first circuit breaker and said second circuit breaker are arranged in a horizontal plane.

10. The interlock assembly of claim 1 wherein said first circuit breaker and said second circuit breaker are arranged in a vertical plane.

* * * * *